US007013850B2

(12) United States Patent
Fattorusso

(10) Patent No.: US 7,013,850 B2
(45) Date of Patent: Mar. 21, 2006

(54) TWO-STROKE ENGINE

(75) Inventor: Antonio Fattorusso, Leinfelden-Echterdingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/834,131

(22) Filed: Apr. 29, 2004

(65) Prior Publication Data

US 2004/0216706 A1 Nov. 4, 2004

(30) Foreign Application Priority Data

Apr. 29, 2003 (DE) ..... 103 19 216

(51) Int. Cl.
*F02B 25/16* (2006.01)

(52) U.S. Cl. ..... 123/73 A

(58) Field of Classification Search ..... 123/73 A, 123/73 PP, 73 AA, 73 AV, 65 P
See application file for complete search history.

(56) References Cited

U.S. PATENT DOCUMENTS 4,378,762 A * 4/1983 Ehrlich ..... 123/73 PP
5,947,066 A * 9/1999 Ishikawa ..... 123/65 P
6,662,765 B1 * 12/2003 Araki ..... 123/73 A
2002/0134326 A1 9/2002 Araki

* cited by examiner

*Primary Examiner*—Henry C. Yuen
*Assistant Examiner*—Hyder Ali
(74) *Attorney, Agent, or Firm*—Walter Ottesen

(57) ABSTRACT

A two-stroke engine has a cylinder defining a combustion chamber which is delimited by an upwardly and downwardly moving piston which drives a crankshaft via a connecting rod. The crankshaft is rotatably journalled in the crankcase (4). The two-stroke engine includes an inlet for fuel and an outlet for exhaust gases. At pregiven piston positions, the combustion chamber is connected to the crankcase via a piston window and at least one transfer channel. The transfer channels open via transfer windows into the combustion chamber and open with the transfer opening into the crankcase. The transfer opening and transfer windows open into a region at the cylinder bore which is passed over by the piston. To obtain a delayed inflow of the air/fuel mixture from the crankcase, the transfer opening is not yet fully closed for a piston moved toward the crankcase when the transfer windows begin to open.

10 Claims, 3 Drawing Sheets

TWO-STROKE ENGINE

CROSS REFERENCE TO RELATED APPLICATION

This application claims priority of German patent application no. 103 19 216.6, filed Apr. 29, 2003, the entire content of which is incorporated herein by reference.

FIELD OF THE INVENTION

The invention relates to a two-stroke engine and especially a two-stroke engine for a portable handheld work apparatus such as a motor-driven chain saw, cutoff machine or the like.

BACKGROUND OF THE INVENTION

The exhaust gas, which develops in two-stroke engines, should be reduced. At the same time, the structural size of the two-stroke engine should become less. In two-stroke engines, the exhaust gas escapes from the outlet while fresh air/fuel mixture already flows into the combustion chamber. Here, it must be prevented that fresh air/fuel mixture leaves the combustion chamber through the outlet because, in this way, the HC values in the exhaust gas increase. For this reason, the transfer channels, through which the fresh mixture flows, should open as late as possible after the opening of the outlet from the combustion chamber. However, by displacing the transfer channels in the direction of the crankcase, the structural size of the engine is increased. The transfer channels must furthermore be dimensioned to be adequately large and to be open sufficiently long in order to ensure the supply of an adequate fresh mixture quantity to the combustion chamber. For these reasons, the constructive arrangement of the transfer channels on the cylinder is greatly reduced.

From U.S. Pat. No. 6,662,765, it is known to advance store exhaust gas in a transfer channel. For this purpose, the transfer channel is closed to the crankcase while exhaust gas flows into the transfer channel from the combustion chamber end. The inflow of air/fuel mixture into the combustion chamber is to be delayed by the increased pressure level in the transfer channel caused by the exhaust gas. It has, however, been shown that an adequate delay cannot be achieved with this arrangement because the pressure in the combustion chamber does not propagate adequately into the transfer channels and no exhaust-gas flow into the transfer channels takes place.

SUMMARY OF THE INVENTION

It is an object of the invention to provide a two-stroke engine wherein good exhaust-gas values can be achieved with a low structural size.

The two-stroke engine of the invention includes a two-stroke engine in a portable handheld work apparatus. The two-stroke engine includes: a cylinder defining a cylinder bore and a longitudinal axis; a piston mounted in the cylinder to undergo a reciprocating movement along the longitudinal axis; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; an inlet for fuel and an outlet for conducting exhaust gases away from the combustion chamber; at least one transfer channel; a piston window formed in the piston; the combustion chamber being connected to the crankcase via the piston window and the transfer channel at pregiven positions of the piston along the longitudinal axis; a transfer window opening into the combustion chamber and a transfer opening opening into the crankcase; the transfer channel communicating with the combustion chamber via the transfer window and communicating with the crankcase via the transfer opening; the transfer opening and the transfer window opening into the cylinder bore in a region thereof traversed by the piston; and, the transfer opening being not yet closed by the piston while moving toward the crankcase while the transfer window begins to open.

According to a feature of the invention, the transfer channel to the crankcase is still open while the transfer channel to the combustion chamber opens. It has been surprisingly shown that the pressure propagation from the combustion chamber into the transfer channel is significantly improved by the still open transfer channel to the crankcase. In this way, the pressure level in the transfer channel corresponds to the pressure level in the combustion chamber. The transfer channel to the crankcase is closed shortly after the opening of the transfer channel to the combustion chamber. Because of this, it is ensured that no exhaust gas from the combustion chamber can arrive in the crankcase. With the transfer channel opening to the crankcase, no air/fuel mixture at first flows into the transfer channel because the pressure in the transfer channel is greater than the pressure in the crankcase. Only when the pressure in the crankcase corresponds approximately to the pressure in the transfer channel because of the further downward movement of the piston in the direction toward the crankcase, a sudden outflow of the mixture from the transfer channel into the combustion chamber takes place. At the same time, the scavenging performance is improved because of the delayed sudden outflow. In this way, low exhaust-gas values of the two-stroke engine are achieved with a low structural size.

The desired control of the transfer channels can take place in a simple manner in that the distance, which is measured in the direction of the cylinder longitudinal axis between the upper edge of the transfer window, which faces toward the combustion chamber, and the lower edge of the transfer opening of the transfer channel, which faces toward the crankcase, is greater than the elevation of the cylinder in the region of the transfer channel, measured parallel to the cylinder longitudinal axis. The piston can not completely close the two openings of the transfer channel simultaneously. For this reason, it is ensured that the transfer opening is still open while the transfer window already opens. A good delay of the outflow results when the distance between the upper edge of the transfer window and the lower edge of the transfer opening is 2 to 4 mm greater than the height of the piston in the region of the transfer channel, that is, when the distance between the upper edge of the transfer window and the lower edge of the transfer opening corresponds to a rotation of the crankshaft by 5° to 30°, especially by 15° to 20°. In order to ensure that the transfer opening already closes shortly after the opening of the transfer window, it is provided that the distance, which is measured in the direction of the cylinder longitudinal axis between the lower edge of the transfer window, which faces toward the crankcase, and the upper edge of the transfer opening, which faces toward the combustion chamber, is less than the height of the piston in the region of the transfer channel which is measured parallel to the cylindrical longitudinal axis. The transfer opening is thereby already partially closed when the transfer window begins to open.

The transfer window opens approximately at the same time or shortly after the opening of the outlet. Especially with an approximately simultaneous opening of the transfer window and the outlet, it is ensured that an adequately high pressure adjusts in the transfer channel. It is practical when the distance of the upper edge of the outlet to the upper edge of the transfer channel corresponds to a rotation of the crankshaft by 0° to 20°. This distance is measured in the direction of the longitudinal axis of the cylinder between the upper edge of the outlet facing toward the combustion chamber and the upper edge of the transfer channel. A simple configuration of the piston results when the piston window is configured as an opening from the piston surface to the piston interior. In order to achieve a symmetrical scavenging of the combustion chamber and therefore the low exhaust-gas values associated therewith, four transfer channels are provided which are arranged symmetrically to a center plane. The center plane contains the longitudinal axis of the cylinder and partitions the outlet approximately at the center.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
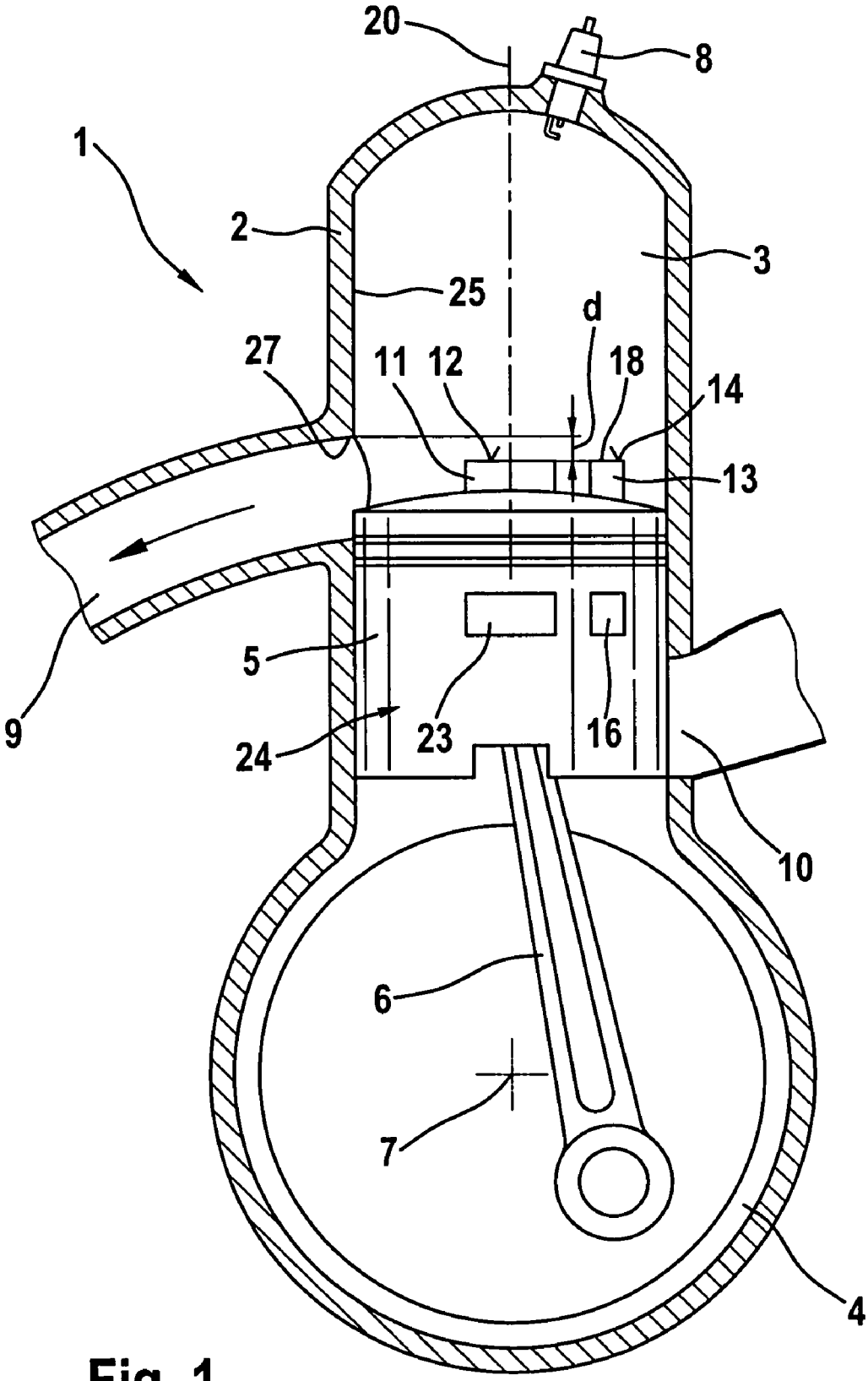
FIG. 1 is a schematic representation of a longitudinal section through a two-stroke engine.

The two-stroke engine 1 shown in FIG. 1 includes a cylinder 2 in which a combustion chamber 3 is configured. The combustion chamber is delimited by a piston 5 which drives a crankshaft 7 via a connecting rod 6. The crankshaft 7 is journalled in a crankcase 4. An inlet 10 opens into the crankcase 4 through which an air/fuel mixture can be supplied to the crankcase. The air/fuel mixture can, for example, be prepared in a mixture processing unit such as a carburetor. The inlet 10 opens at the cylinder bore 25 and is slot controlled by the piston skirt 24 of the piston 5. An outlet 9, which is likewise slot controlled, leads out of the combustion chamber 3. Transfer channels 11 and 13 are provided in the cylinder 2 and connect the combustion chamber 3 to the crankcase 4 at pregiven positions of the piston 5. Two outlet-near transfer channels 11 and two outlet-remote transfer channels 13 are provided. These channels are arranged symmetrically to a center plane which forms the section plane in FIG. 1.

The outlet-near transfer channels 11 open via transfer windows 12 into the combustion chamber 3 and the outlet-remote transfer channels 13 open into the combustion chamber 3 via transfer windows 14. The piston 5 has piston windows 16 and 23 which are configured as openings from the piston surface 24 into the piston interior. The transfer channels (11, 13) are connected to the crankcase 4 in the region of bottom dead center of piston 5 via the piston windows (16, 23). The crankcase ends of the transfer channels (11, 13) are thereby arranged in the cylinder 2 at an elevation which corresponds to the position of the piston windows (16, 23) in the region of bottom dead center of the piston 5.

The transfer windows (12, 14) are so arranged that their upper edges 18, which face toward the combustion chamber 3, are arranged approximately at the elevation of the upper edge 27 of the outlet 9 which faces toward the combustion chamber 3 or are offset relative to the upper edge 27 of the outlet 9 by a distance (d) in the direction toward the crankcase 4. The distance (d) corresponds to a rotation of the crankshaft 7 by 0° to 20°.

Figure 2:
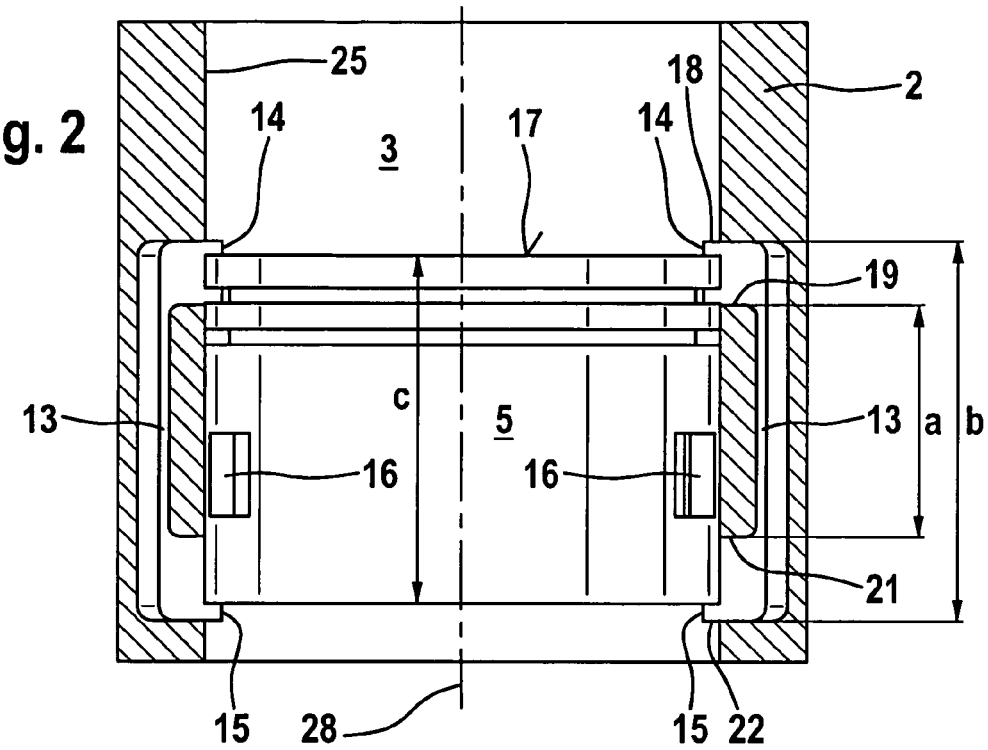
FIGS. 2 to 4 show the cylinder of the two-stroke engine with the piston arranged therein in different piston positions.

FIG. 2 shows a section through the cylinder 2 at the elevation of the outlet-remote transfer channels 13. The transfer channels 13 are arranged symmetrically to the center plane 28 which partitions the outlet 9 of the two-stroke engine 1 approximately at the center and the center plane 28 includes the longitudinal axis 20 of the cylinder. The transfer channels 13 open via transfer openings 15 into the crankcase 4. The transfer openings 15 are, in the same manner as the transfer windows 14, arranged in a region at the cylinder bore 25 which is passed over by the piston 5. Accordingly, the transfer openings 15 as well as the transfer windows 14 are slot controlled. The transfer channels 13 are configured in the shape of cup handles and are closed over a segment of their length toward the cylinder interior space. The upper edge 21 of the transfer opening 15 faces toward the combustion chamber 3 and the lower edge 19 of the transfer window 14 faces toward the crankcase 4. The upper edge 21 is at a distance (a) to the lower edge 19 which distance (a) is less than the height (c) of the piston 5 in the region of the transfer channels 13. In the embodiment shown, the piston base 17, which delimits the combustion chamber 3, is configured to be even in the same manner as the end of the piston 5 facing toward the crankcase 4 and runs perpendicularly to the cylinder longitudinal axis 20 so that the piston 5 at each location has the same height (c) measured parallel to the cylinder longitudinal axis 20.

The distance (b) is measured in the direction of the longitudinal axis of the cylinder between the lower edge 22 of the transfer opening 15 and the upper edge 18 of the transfer window 14 and is greater than the height (c) of the piston 5. For the position of the piston 5 shown in FIG. 2 for the movement of the piston 5 from the combustion chamber 3 in the direction toward the crankcase 4, the transfer opening 15 is still open while the transfer window 14 is already opening. Advantageously, the distance (b) is greater by 2 to 4 mm than the height (c) of the piston 5 so that the transfer opening 15 is still 2 to 4 mm open while the transfer window 14 is opening. The distance (b) advantageously corresponds to a rotation of the crankshaft of 5° to 30° and especially 15° to 20°.

During operation of the two-stroke engine 1, an air/fuel mixture is first drawn into the crankcase 4 by suction in the top dead center region of the piston 5. With the downward stroke of the piston 5, the mixture is compressed in the crankcase 4 and then flows through the piston windows 16 and 23, the transfer openings 15 and the transfer channels 13 and 11 through the transfer windows 12 and 14 into the combustion chamber 3. In the region of top dead center of the piston 5, the air/fuel mixture is ignited by the spark plug 8 mounted in the cylinder 2. In the subsequent downward movement of the piston 5, the outlet 9 opens approximately at the same time as the transfer channels 11 and 13 or shortly ahead of the transfer channels 11 and 13. While the transfer channels are opening, the transfer openings 15 are not yet completely closed to the crankcase. The high pressure present in the combustion chamber 3 can therefore propagate into the transfer channels 11 and 13 so that a high pressure is present in the transfer channels 11 and 13. Before exhaust gases can flow out of the combustion chamber 3 into the crankcase 4, the transfer openings 15 are closed by the further downwardly moved piston 5.

Figure 3:
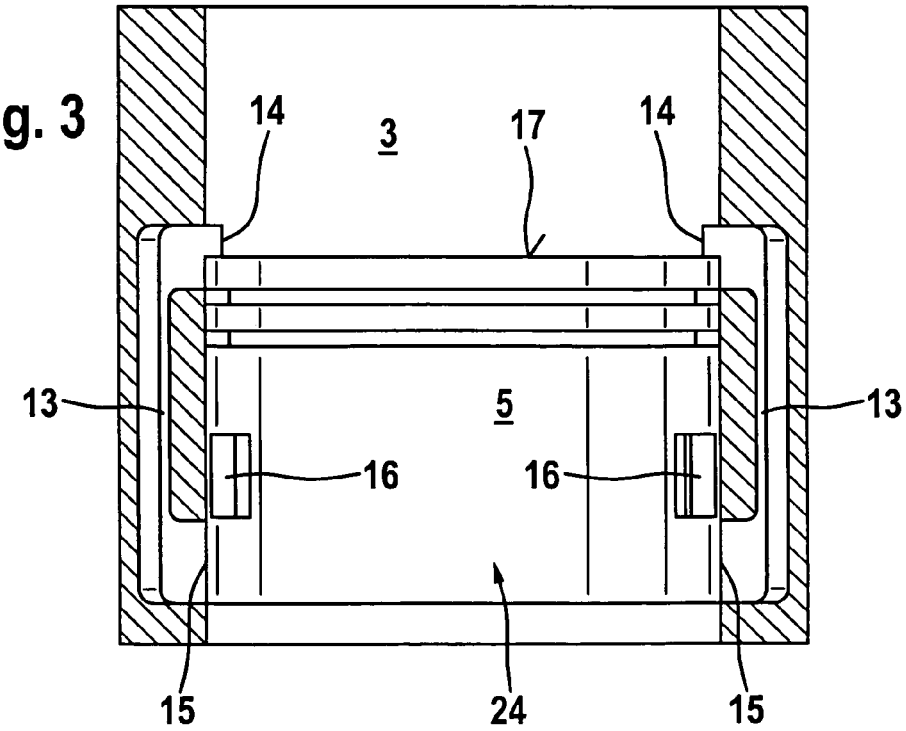
Figure 4:
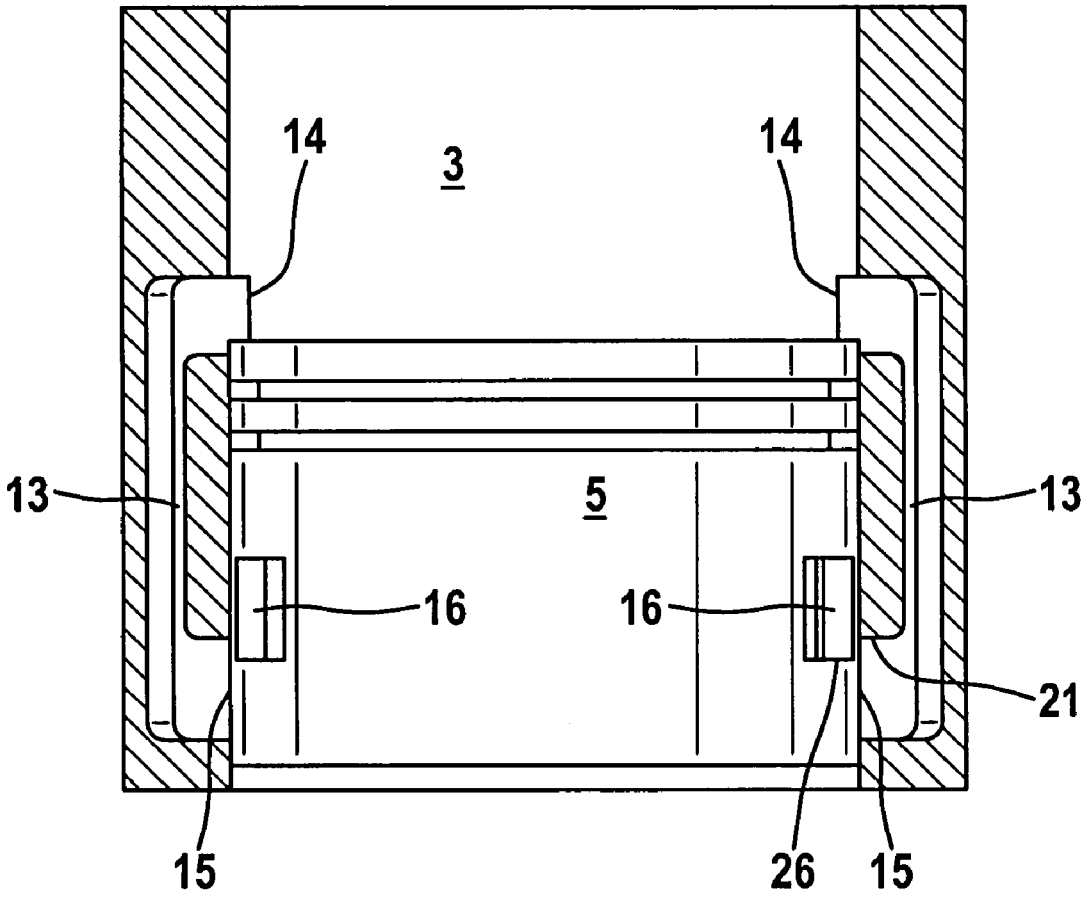

In FIG. 3, the transfer openings 15 are shown closed by the piston skirt 24. At the time point at which the transfer openings 15 are already completely closed, the transfer windows 14 are only approximately open by half from the piston base 17. For a further downward movement of the piston 5 in the direction toward the crankcase 4 as shown in FIG. 4, the transfer opening 15 is opened by the piston windows 16. The position of the lower edge 26 of the piston windows 16 determines the time point at which the transfer channels establish a connection between the combustion chamber 3 and the crankcase 4. The lower edges 26 of the piston windows 16 face toward the crankcase 4.

At the time point of the opening of the transfer opening 15 to the crankcase 4, the pressure, which is present in the crankcase 4, is less than the exhaust-gas pressure present in the transfer channels 13 and 11. For this reason, the air/fuel mixture does not begin to flow through the transfer channels (11, 13) into the combustion chamber 3 immediately when the transfer openings 15 start opening. Rather, the inflow into the combustion chamber 3 is delayed for so long until the pressure of the air/fuel mixture in the crankcase 4 has reached the exhaust-gas pressure in the transfer channels 11 and 13. After this time delay, the air/fuel mixture begins to flow out of the transfer channels (11, 13), that is, out of the crankcase 4, suddenly into the combustion chamber 3. Because of the delay of the inflow, a good scavenging result can be obtained. At the same time, the sudden inflow ensures that a sufficient quantity of the air/fuel mixture can flow into the combustion chamber 3. The delay permits the arrangement of the transfer windows (12, 14) to be approximately at the elevation of the exhaust-gas outlet 9. In this way, a reduced structural height of the two-stroke engine 1 can be obtained.

In lieu of four transfer channels, another number of transfer channels can be practical. It can be practical to configure the control times differently for the individual transfer channels so that an asymmetric scavenging of the combustion chamber 3 is obtained.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine in a portable handheld work apparatus, the two-stroke engine comprising:

a cylinder defining a cylinder bore and a longitudinal axis;

a piston mounted in said cylinder to undergo a reciprocating movement along said longitudinal axis;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

an inlet for fuel and an outlet for conducting exhaust gases away from said combustion chamber;

at least one transfer channel;

a piston window formed in said piston;

said combustion chamber being connected to said crankcase via said piston window and said transfer channel at pregiven positions of said piston along said longitudinal axis;

a transfer window opening into said combustion chamber and a transfer opening opening into said crankcase;

said transfer channel communicating with said combustion chamber via said transfer window and communicating with said crankcase via said transfer opening;

said transfer opening and said transfer window opening into said cylinder bore in a region thereof traversed by said piston; and, said transfer opening being not yet closed by said piston while moving toward said crankcase while said transfer window to said combustion chamber begins to open and shortly after said transfer channel is opened to said combustion chamber, said transfer channel is closed to said crankcase by the further downwardly moved piston.

2. The two-stroke engine of claim 1, wherein said transfer window has an upper edge and said transfer opening has a lower edge; said upper edge is at a distance (b) from said lower edge measured in the direction of said longitudinal axis; said piston has a height (c) measured parallel to said longitudinal axis; and, said distance (b) is greater than said height (c) in the region of said transfer channel.

3. The two-stroke engine of claim 2, wherein said distance (b) is 2 mm to 4 mm greater than said height (c) in the region of said transfer channel.

4. The two-stroke engine of claim 2, wherein said distance (b) corresponds to a rotation of said crankshaft of 5° to 30°.

5. The two-stroke engine of claim 2, wherein said distance (b) corresponds to a rotation of said crankshaft of 15° to 20°.

6. The two-stroke engine of claim 2, wherein said transfer window has a lower edge facing toward said crankcase and said transfer opening has an upper edge facing toward said combustion chamber; said lower edge of said transfer window is at a distance (a) from said upper edge of said transfer opening; and, said distance (a) is less than said height (c) of said piston in the region of said transfer channel.

7. The two-stroke engine of claim 1, wherein said transfer window opens approximately simultaneously with or shortly after the opening of said outlet.

8. The two-stroke engine of claim 7, wherein said outlet has an upper edge facing toward said combustion chamber; said upper edge of said outlet is at a distance (d) from said upper edge of said transfer window measured in the direction of said longitudinal axis; and, said distance (d) corresponds to a rotation of said crankshaft of 0° to 20°.

9. The two-stroke engine of claim 1, wherein said piston window is configured as an opening from the outer surface of said piston to the interior thereof.

10. The two-stroke engine of claim 1, said outlet being partitioned approximately in the center by a center plane containing said longitudinal axis; and, said two-stroke engine further comprising four of said transfer channels arranged symmetrically to said center plane.

* * * * *